US006547064B2

(12) United States Patent
Klair

(10) Patent No.: US 6,547,064 B2
(45) Date of Patent: Apr. 15, 2003

(54) MULTIPURPOSE CONTAINER

(76) Inventor: Scott L. Klair, 1218 E. Rosevelt, Salt Lake City, UT (US) 84105

( * ) Notice: Subject to any disclaimer, the term of this patent is extended or adjusted under 35 U.S.C. 154(b) by 0 days.

(21) Appl. No.: 09/860,955

(22) Filed: May 21, 2001

(65) Prior Publication Data

US 2002/0170832 A1 Nov. 21, 2002

(51) Int. Cl.[7] ..... B65D 25/08

(52) U.S. Cl. ..... 206/219; 206/575; 206/459.5; 53/449

(58) Field of Search ..... 206/219, 222, 206/232, 459.5, 575, 579; 53/449

(56) References Cited

U.S. PATENT DOCUMENTS 2,925,719 A * 2/1960 Robbins et al. ..... 206/219
3,255,872 A * 6/1966 Long et al. ..... 206/219
3,763,622 A * 10/1973 Stanley, Jr. ..... 53/431
3,887,346 A * 6/1975 Erdman ..... 62/4
3,950,158 A 4/1976 Gossett
4,514,446 A * 4/1985 Kadono et al. ..... 53/472
4,534,509 A * 8/1985 Holzner ..... 239/34
4,540,089 A 9/1985 Maloney
4,735,308 A * 4/1988 Barner ..... 206/204
4,759,472 A * 7/1988 Strenger ..... 222/541.4
4,856,651 A * 8/1989 Francis, Jr. ..... 126/263.07
5,353,927 A 10/1994 Stupar et al.
5,492,219 A 2/1996 Stupar
5,603,729 A * 2/1997 Brown et al. ..... 607/114
5,658,597 A * 8/1997 Breidenstein et al. ..... 206/575
6,068,820 A * 5/2000 De Guzman ..... 134/6
6,352,585 B1 * 3/2002 Diesso ..... 106/35

OTHER PUBLICATIONS

Identifying and Preserving Wildlife Tracks, Circular 561, Jon C. Boren et al., Mar. 1999.*
National Audubon Society Pocket Guide, Familiar Animal Tracks of North America, Alfred A. Knopf, 1993.*
Collecting Animal Traps, by Nova Scotia Museum, Sep. 1999.*

* cited by examiner

*Primary Examiner*—David T. Fidei
(74) *Attorney, Agent, or Firm*—Brian C. Trask

(57) ABSTRACT

A container in which to store, transport, and mix a plaster compound. The container has a sealed plastic mix envelope inside which a preferentially rupturable plastic bladder holding a quantity of water is attached by a flexible adhesive film. The mix envelope also contains a quantity of dry plaster mix in a proscribed ratio to the water. A plaster cast may be created with minimal mess by pressing firmly on the envelope to rupture the bladder, kneading the mix envelope to fully wet the plaster mix, forming an opening in the envelope, and pouring the mixed plaster slurry into a mold.

22 Claims, 2 Drawing Sheets

MULTIPURPOSE CONTAINER

BACKGROUND OF THE INVENTION

1. Field of the Invention

This invention relates generally to containers, and more particularly to multiple function containers. An apparatus constructed according to principals of this invention can compartmentally store, transport, and also serve as a no-mess mixing container for two or more ingredients.

2. State of the Art

Containers are generally well known, and yet concerted effort is directed at their improvement for certain specialized purposes, as evidenced by U.S. Pat. Nos. 3,950,158; 4,540,089; 5,353,927 and 5,492,219. U.S. Pat. No. 3,950,158 issued in 1976 to Gossett. Gossett discloses a container adapted to serve as a thermal pack and fundamentally forming a bag-within-a-bag. The inner bag may contain a fluid which is isolated from a chemical stored inside the outer bag. Rupturing the inner bag allows the fluid and chemical to mix, thereby forming a desired endothermic or exothermic reaction. The inner and outer bags are disclosed to be simultaneously sealed at a common seam.

U.S. Pat. No. 4,540,089 issued in 1985 to Maloney, and discloses a multicompartment bag in which two or more ingredients may be mixed. However, Maloney teaches an inner bag having a mouth opening through which a user may insert a fluid to a measured amount. A user is therefore inconveniently required to add an ingredient prior to mixing the bag contents.

U.S. Pat. No. 5,353,927 issued to Stupar et. al in 1994 and U.S. Pat. No. 5,492,219 issued to Stupar in 1996. Stupar et al. in '927 disclose a two compartment bag for separately storing and mixing, when desired, materials such as epoxy resins. The compartments may communicate through a series of perforation holes which are easily ruptured. These holes are covered by a cap to prevent cross-compartment leakage until sufficient pressure is placed on one compartment. In '219, Stupar extends the two compartment mixing bag apparatus to a three compartment bag. In both disclosures, the bags are taught as sharing sealed edges.

A commercially available product sold by Educational Insights™ under the name Dueling Dino Dig™ provides a block of material with embedded objects representative of dinosaur bones. A child may excavate such objects from the block of material. However, the child is deprived of the experience of creating the block and placing the bones for subsequent excavation. An apparatus to provide a more complete educational and participatory experience would be a desirable improvement.

BRIEF SUMMARY OF THE INVENTION

The present invention provides an apparatus, and a method for making the apparatus, for a container capable of storing, transporting, and mixing two or more separately confined ingredients within a no-mess mixing container.

The present invention may generally be characterized as a container having the ability to segregate two or more items from one another within separate compartments until such time as mixing of the items is desired. Items storable in the various compartments of the present invention may include fluids, solids, granules, powders, pastes, or the like. Prior to their placement in the separate container compartments, the individual items may be measured to establish desired portions of each item. Items may therefore be segregated in a ratio ready for mixing together. Typically, a bladder compartment, containing one or more items, stored within an envelope compartment, which also contains one or more items, is preferentially rupturable over the envelope compartment. Upon rupture, the bladder compartment may release its item, or items, for mixing with another item, or items, within the envelope compartment. The compartmentalized container affords storage and transportation of the premeasured and segregated items until such time as mixing of the items is desired. The envelope compartment may then serve as a mixing container for the no longer segregated contained items. Mixing is typically accomplished by kneading, or transversely squeezing, and shaking the envelope compartment. The virtually fully contained nature of the mixing process promotes an essentially no-mess mixing operation. Subsequent to mixing, an opening may be made in the envelope and the mixed contents poured out without risk of the bladder either exiting the envelope or obstructing the opening.

In more particular detail, the invention is a sealable mixing envelope housing a preferentially rupturable dispensing bladder. The bladder typically contains a premeasured quantity of a first ingredient. The mixing envelope typically contains a premeasured quantity of a second ingredient. The quantities of the first and second ingredients may be determined in-part according to a desired mix ratio for the product. The dispensing bladder is desirably affixed to an interior surface of the mixing envelope by use of an adhesive. Preferred adhesives for such attachment are flexible and transparent, such as a two-sided adhesive film.

Exemplary mixing envelopes may have structure arranged as a spout having proximal and distal ends, the proximal end being in fluid communication with the envelope, and the distal end carrying a closure structure. An area of reduced strength may be provided at the distal end to facilitate removal of the closure structure whereby to form an opening through which to pour a compound of the mixed ingredients. The mixed compound may be a fluid, slurry, paste, or a dry mixture. Mixing envelopes are typically sized in volumetric capacity relative to an enclosed bladder such that, when the envelope is sealed subsequent to removing excess air, the ingredient contained only by the envelope functions substantially to reinforce the bladder whereby to resist unintentional bladder rupture. Both mix envelopes and bladders are desirably filled to less than their total capacity to reduce likelihood of undesired rupture.

A mixing envelope may be provided hanging structure from which to suspend the apparatus, such as for retail display. The bladder can be affixed to a location inside the envelope such that the invention hangs in a proscribed orientation. A mixing envelope may provide a substantially transparent window portion through which the bladder may be seen. Preferred envelopes carry instructions printed on their exterior surfaces to guide a user in mixing and use of the ingredients. Envelopes may also carry depictions of animal tracks at a reduced scale from full size and annotated as to their actual size. In such case, it is useful also to include a ruler portion for measuring actual animal tracks for comparison to the depictions whereby to make a track identification.

The invention may also include excavation objects inside a mixing envelope. Such objects desirably have more durability than material of the casting. These objects can then be excavated from within a casting by a procedure encompassing chipping away of the casting material from the objects. Exemplary excavation objects may include representations of dinosaur bones. Subsequent to their excavation from within a casting, the bones may be assembled into a skeleton.

These features, advantages, and alternative aspects of the present invention will be apparent to those skilled in the art from a consideration of the following detailed description taken in combination with the accompanying drawings.

BRIEF DESCRIPTION OF THE SEVERAL VIEWS OF THE DRAWINGS

In the drawings, which illustrate what are currently considered to be the best modes for carrying out the invention.

DETAILED DESCRIPTION OF THE INVENTION

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

Figures 1, 2, 3, 4:
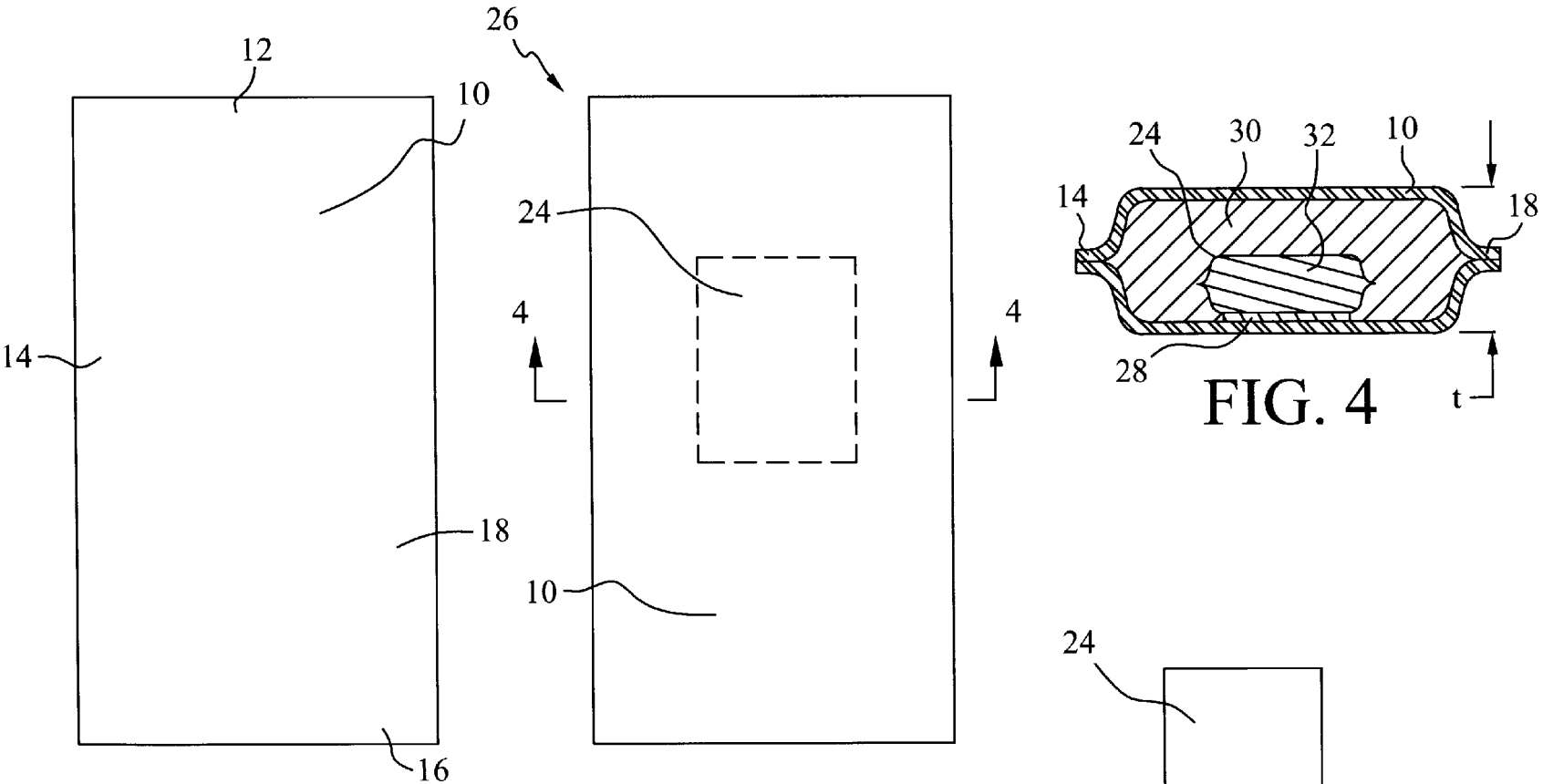
FIG. 1 is a plan view of one embodiment of an envelope.
FIG. 2 is a plan view of one embodiment of a bladder.
FIG. 3 is a plan view of a first embodiment of an assembled container according to the present invention.
FIG. 4 is a cross-section of the embodiment of FIG. 3, taken through the section 4—4 and looking in the direction of the arrows.

An example of one embodiment of an envelope 10 according to the present invention is illustrated in FIG. 1. Envelope 10 has four edges including a top 12, left side 14, bottom 16, and right side 18. While the illustrated envelope 10 is substantially rectangular, other shapes are also workable. For example, nonrectangular and even nonregular outline shapes for an envelope 10, including outlines with animal shapes, are within contemplation.

An envelope 10 may be formed from a plastic film or sheet, or other transversely flexible material. An envelope 10 may be manufactured using any known technique for making plastic, or other material, bags or containers. It is currently preferred to manufacture envelopes 10 from a plastic material that can be heat sealed, although such is not a requirement. One currently preferred material of composition of the plastic is polyethylene. Other workable materials nonexclusively include polyester/polyethylene, low to high density polyesters, laminate foil barrier film, and metalized polyester barrier film. One currently preferred embodiment of the envelope 10 is formed from plastic film stock of about 0.006 inches in thickness. An envelope 10 may be manufactured to encompass any convenient size in length, depth, and width.

An example of one embodiment of a bladder 24 is illustrated in FIG. 2. Bladder 24 may be manufactured of materials and using similar techniques to those employed in constructing an envelope 10. While bladder 24 is illustrated as being substantially rectangular, such is not required. One currently preferred embodiment of the bladder 24 is formed from plastic film stock of about 0.002 inches in thickness. A bladder 24 is typically sized relative to a corresponding envelope 10 to accommodate a ratio of volumes or weights of segregated items carried within the respective bladder 24 and envelope 10.

A first embodiment of a container according to the present invention, indicated generally at 26, is illustrated in FIG. 3. Bladder 24 contains a first material and is positioned inside envelope 10. It is currently preferred to affix a bladder 24 to an inside surface of envelope 10 using a flexible adhesive. An acrylic-based adhesive has been determined to be suitable for such purpose. One exemplary adhesive is a transparent, two-sided, adhesive film sold by 3M™ under the trade name 300LSE Laminating Adhesive. Use of an adhesive permits locating a bladder 24 in a substantially permanent position relative to the envelope 10 edges 12, 14, 16, and 18. Such an affixed bladder 24 will remain inside the envelope 10 during, and subsequent to, the discharge of the envelope's contents. A bladder 24 affixed to a known location is also easier to locate and rupture than an unrestrained bladder 24 when mixing the contents of container 26 is desired.

Referring now to FIGS. 3 and 4, it is currently preferred to locate a bladder 24 spaced apart from edges 12, 14, 16, and 18, by affixing bladder 24 to an envelope 10 with an adhesive 28. In such a configuration, material 30 carried inside envelope 10 and external to the bladder 24 can at least partially surround the bladder 24. The surrounding material 30 can form supportive columns, or cushions, which serve partially to protect the bladder 24 from unintended rupture and corresponding discharge of material 32 during storage and transportation.

Spacing the bladder 24 from the edges 12, 14, 16, and 18 also permits a bladder 24 to be sealed as a separate operation from sealing an envelope 10. In certain embodiments of the invention comprising a plastic bag inside a larger plastic bag, it has been determined that simultaneously sealing the inner and outer bag, thereby forming a single sealing seam, leads to a reduction in strength of the sealing seam. The sealing seam in such a configuration must unavoidably include two thicknesses of plastic, due to the overlap between the inner and outer bags. The heat and pressure required to seal the overlapped section has been found to be too great for the nonoverlapped section of the sealing seam. An area of reduced strength is created at the nonoverlapped section of the seam. This area of reduced strength may fail and leak when rupturing the inner bag to mix the contents of the container 26. Sealing the inner bag separately and locating it spaced apart from the edges of the outer bag allows the outer bag to be sealed only to itself, forming a sealing seam of uniform thickness and strength in the outer bag.

It is currently preferred to space the bladder 24 at least from the last-formed sealing seam which closes the envelope 10. However, it is not detrimental for a bladder 24 to be in contact with seams or edges of the envelope. It is simply most convenient to provide a separation between a bladder 24 and the last-formed seal to facilitate sealing an envelope 10 without entrapping portions of the bladder 24 in the last-formed seal. Separately sealing the envelope 10 also facilitates evacuation of excess air, if present, from the envelope 10 prior to sealing an envelope 10. In the context of this disclosure, excess air may be defined as that amount of air, in addition to the contents of the envelope 10, which would preclude preferential rupture of the bladder 24 over rupture of the envelope 10.

Bladders 24 may be filled and stockpiled, or manufactured on a just-in-time basis. Filling and sealing the containers of the invention 26 may be done manually, or with automated equipment. In one currently preferred embodiment of the invention 26, bladders 24 are filled with a liquid. In this case, it is preferred substantially to evacuate air from the bladder 24. A reduction in entrained air is done primarily for packaging efficiency. However, complete evacuation is not required. Furthermore, a certain amount of the available total volume of the bladder 24 is desirably left empty of both air and fluid. This empty volume allows the material carried inside bladder 24 to deflect away, in a localized area, from a transversely impinging object, thereby to avoid premature and undesired rupture of the bladder 24.

Envelopes 10 are also advantageously sized to accommodate a larger volume than the volume occupied by all of the segregated items and any excess air sealed therein. The extra unfilled capacity of the envelope 10 provides sufficient envelope transverse flexibility to enable both preferential rupture of a bladder 24 and mixing of the contained items. If the envelope 10 were filled to capacity, for example with air, the air would potentially reduce transverse flexibility of the envelope, increasing the probability that the envelope itself would rupture while attempting to rupture the bladder 24 and mix the envelope contents. Mixing capability with an effectively overstuffed envelope 10 may be reduced by limiting the ability of a user to knead the contents, thereby reducing a user's control over the movement and mixing of material inside the envelope.

It should be recognized that an envelope sized significantly larger than required simply to contain the bladder 24 loaded with a first material or substance and whatever desired second ingredient or compound, along with a certain amount of extra room to accommodate an effective kneading motion, may reduce the effect of bladder cushioning by the second ingredient or compound. The result is that a loaded and sealed container 26 may be more thin than the bladder 24. In such case, the bladder 24 may effectively protrude transversely and may be more susceptible to unintended rupture during storage and transport. However, a currently preferred embodiment of the invention 26 has a bladder 24 extending substantially through the entire thickness (indicated by t, see FIG. 4) of the envelope 10.

The reduced overall thickness of the material forming the aforementioned currently preferred embodiment bladder 24 compared to material forming the aforementioned currently preferred embodiment envelope 10 is one way to promote preferential rupture of bladder 24 when envelope 10 is transversely squeezed. It is also within contemplation to provide a localized area of reduced thickness or strength in an alternate bladder, which may be made from material having substantially the same (or even greater) thickness as material forming an envelope 10. The area of reduced thickness or strength in such an alternative bladder can promote bladder rupture at such a location preferentially over rupture of the envelope 10. Of course, it is also possible simply to manufacture a bladder from a material having less tear resistance than material forming an envelope. In any event, it is desired that a bladder 24 can be ruptured preferentially over the envelope 10 in which the bladder 24 is sealed. It is preferred to provide a "hard" rupture of a bladder 24 to promote a rushing egress of the ingredient contained therein and to promote mixing with the contents of the envelope 10. Such quick evacuation of the bladder is particularly beneficial rapidly to create a slurry mixture having a short working or pot life.

Figure 5:
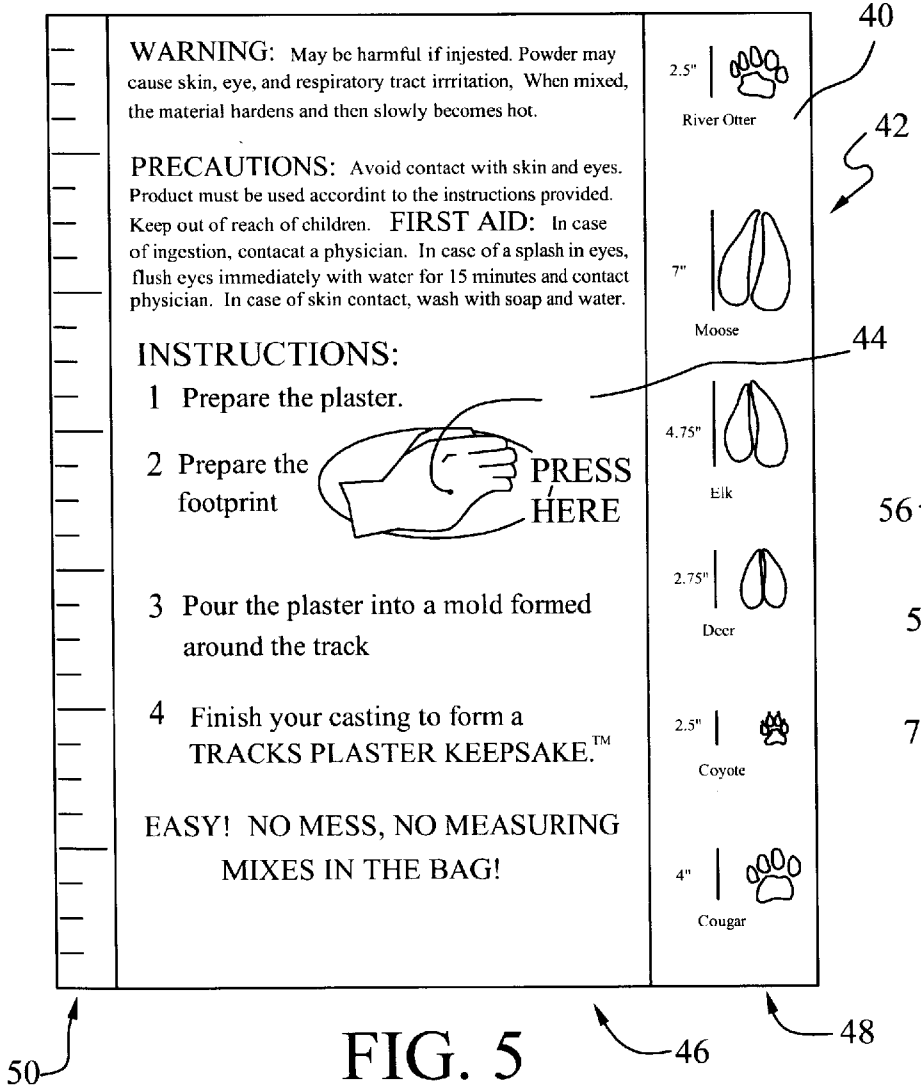
FIG. 5 is a plan view illustrating surface adornment of an embodiment of an envelope.

Reference will now be made to FIG. 5, which illustrates surface adornment of an envelope 40, of a currently preferred container embodiment indicated generally at 42. The envelope 40 has a substantially transparent window portion 44 through which a bladder 24 may be seen. This window 42 may facilitate visual location of the bladder 24 for its rupture. Of course, the envelope 40 may also be marked to indicate at which location to press for bladder rupture. An outer surface of envelope 40 may carry instructions, indicated generally at 46, for mixing and general use of the ingredients stored within. An envelope 40 may also carry depictions of animal tracks at a reduced scale from full size, indicated generally at 48, and annotated as to their actual size, and a ruler portion, indicated generally at 50, for measuring animal tracks for comparison to depictions 48 whereby to make a track identification.

Figure 6:
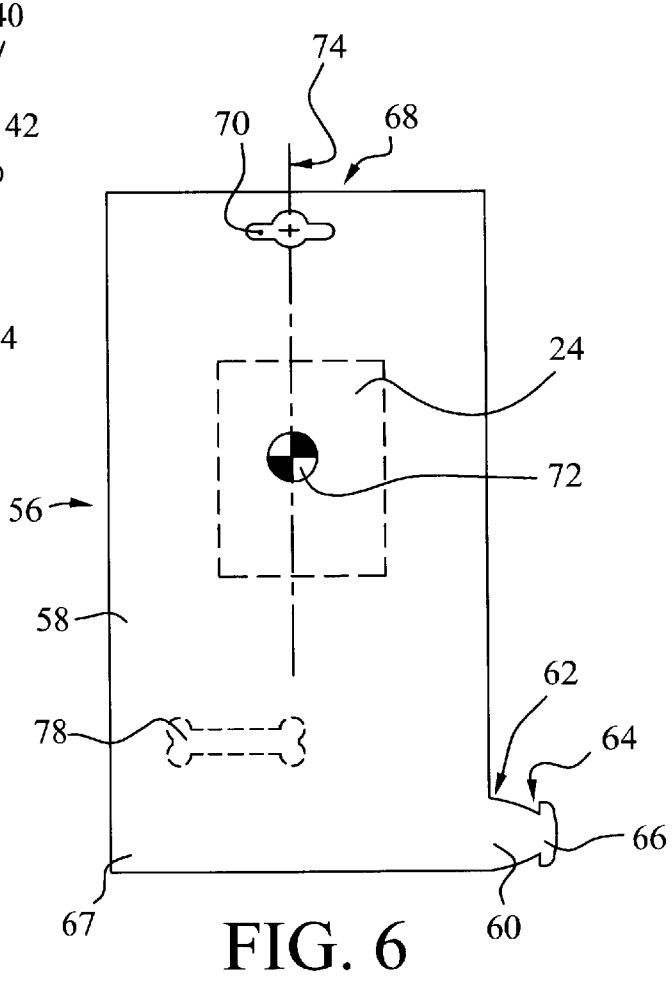
FIG. 6 illustrates an alternative embodiment of the invention.

With reference to FIG. 6, details of an alternative container, indicated generally at 56, will now be discussed. Envelope 58 of container 56 illustrates one embodiment of a spout 60 for directing a discharge of the mixed slurry contents of container 56. Spout 60 has a proximal end in open communication with the inside of envelope 58. A distal end 64 of spout 60 may carry a closure structure, such as an easy tear-off closure 66. An easy tear-off closure 66 may have an area of reduced strength to facilitate separation from a spout 60. Of course, the end of a spout may simply be cut from the envelope, as with a pair of scissors. A corner 67 of an envelope 58 may function as an exemplary spout.

Envelope 58 is also illustrated as having hanging structure, indicated generally at 68, from which a container 56 may be suspended. Illustrated hanging structure 68 includes a through-hole 70 in envelope 58. Of course it must be realized that through-hole 70 is sealed from the contents of envelope 58 to prevent any leaks at the hanging structure 68. Structure 68 may be located and arranged in harmony with placement of bladder 24 and the contents of an envelope 58 to create a center of gravity 72 for container 56 that is located along an axis passing through hole 70 and generally indicated at 74. Suitable location of structure 68 in cooperation with contents of container 56 permits the hanging orientation of a container 56 to be defined. For example, containers 56 may be manufactured uniformly to hang from a display structure at a proscribed angle.

Certain preferred embodiments of the invention are adapted to create castings of animal tracks. The container 26 of such embodiments typically has a sealed plastic mix envelope 10 inside which a preferentially rupturable plastic bladder 24 holding a quantity of water is attached by a flexible adhesive film 28. The mix envelope 10 also typically contains a quantity of dry plaster mix in a proscribed ratio to the water. A plaster cast may be created with minimal mess by pressing firmly on the envelope 10 to rupture the bladder 24, kneading the mix envelope 10 to fully wet the plaster mix, forming an opening in the envelope 10, and pouring the mixed plaster slurry into a mold.

In certain embodiments, a bladder 24 may be loaded with water, and an envelope 10 may be loaded with a dry plaster or cement mix. It has been determined that both the water and the plaster mix are best equilibrated to a similar temperature prior to sealing of a container 26. A similar temperature between the ingredients is desirable to prevent condensation of water droplets on the outer surface of the bladder. Such condensation can start an exothermic reaction with the plaster mix. The heat liberated by the reaction can cause the condensation of additional water, further increasing the amount of plaster involved in the reaction. A result of such condensation is the undesirable formation and presence of hardened plaster inside the envelope. Condensation may also be reduced or avoided by maintaining the plaster mix in a dry condition.

The invention can conveniently be sized to form mixed ingredients having a combined discharged weight in a range from micrograms to about 100 pounds. Embodiments larger than about 100 pounds in size may require a mechanical assist for mixing and to maneuver. One embodiment for mixing plaster to create castings of animal tracks has an envelope 10 measuring about 7 inches by about 8½ inches when empty and laying flat. The bladder 24 used in that embodiment holds water and measures about 4 inches by about 6 inches when similarly empty and flat. This embodiment mixes the water with about 15 oz. of a dry plaster mix. A typical plaster used for such an application may have a weight ratio of 55:100 for water to dry plaster mix.

The invention finds particular application to mixing cements and plasters of various types but without causing a mess during the process. For purpose of this disclosure, the term "plaster" will be used to encompass products including plasters and cements. With the present invention, a user is freed from the onerous and error prone ingredient measuring steps. No stirring utensils or additional mixing containers are required, thereby reducing cleanup effort. Cleanup is straightforward; simply dispose properly of the container 26 once a mix batch has been extracted. The product or casting is substantially guaranteed uniform properties between mix batches due to the repeatable nature of premeasured ingredients. The same advantages apply equally to other compounds or mixtures stored and mixed inside the invention.

The invention may be used in a tremendous range of fields, and for a wide range of applications. Broadly, the invention may be used in any situation benefiting from the prepackaging and storage of items which require mixing just prior to their use. For example, embodiments may contain premeasured and packaged foodstuffs for convenient meal preparation. Epoxies and multipart adhesives may beneficially be packaged with an embodiment of the invention functioning as a single-use container. In the dental field, convenience and quality control may be improved by storing and mixing individual batches of Dental Stone™, or any other adhesive, cement, or plaster, in an embodiment of the invention. The invention may be employed for evidentiary castings in the field of forensics. In a forensic application, the cast material desirably is hard, durable, and fast setting. Gypsum cements typically used for such application include materials sold by the United States Gypsum Company under the trade names Hydrocal™ and HydroStone™. Tints of various colors, including yellow, may be included in the envelope 10 to facilitate identification of various features in a casting.

The invention may also include excavation objects 78, either inside a mixing envelope 10, or conveniently packaged for insertion into a casting. Such excavation objects desirably will have more durability than material of the casting. Casting material in such an embodiment of the invention is desirably compounded to be a substantially friable material. The objects can then be excavated from within a casting by a procedure encompassing chipping away of the casting material from the objects. The invention thereby provides a more interactive participation in an excavation project than currently commercially available. A person using the invention in such circumstance is given confidence that the excavation objects are actually present in the casting. Exemplary excavation objects may include representations of dinosaur bones. Subsequent to their excavation from within a casting, the bones may be assembled into a skeleton.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A multifunction apparatus for storing, transporting, and mixing together two or more ingredients, comprising:

a sealed mixing envelope comprising therein:

a preferentially rupturable dispensing bladder containing a premeasured quantity of a first ingredient comprising a fluid, and a premeasured quantity of a second ingredient located external to said bladder, said first and second quantities being determined in-part according to a product mix ratio; and wherein:

said dispensing bladder is affixed to an interior surface of said mixing envelope by use of a flexible, acrylic-based, adhesive operable to retain said bladder inside said dispensing envelope subsequent to a rupturing of said bladder and a kneading and mixing operation on said envelope operable to mix said first and second ingredients.

2. The apparatus of claim 1, said second ingredient comprising a substance forming a moldable slurry when initially mixed with said fluid in accordance to said mix ratio, and capable of achieving a solid form after a period of time subsequent to creating said slurry.

3. The apparatus of claim 1, said adhesive being adhered for attachment of said bladder at a location spaced apart from a sealing seam of said mixing envelope.

4. The apparatus of claim 3, said adhesive comprising a two-sided adhesive film.

5. The apparatus of claim 1, wherein a first end of said envelope is provided hanging structure from which to suspend said apparatus, and wherein said bladder is affixed to a location inside said envelope such that an apparatus suspended from said hanging structure hangs in a proscribed orientation.

6. The apparatus of claim 1, said envelope comprising a substantially transparent window portion through which said bladder may be seen.

7. The apparatus of claim 1, an outer surface of said envelope being adapted to carry instructions for mixing and use of said ingredients.

8. The apparatus of claim 1, an outer surface of said envelope carrying:

depictions of animal tracks at a reduced scale from full size and annotated as to their actual size, and a ruler portion for measuring animal tracks for comparison to said depictions whereby to make a track identification.

9. The apparatus of claim 1, said mixing envelope further comprising therein:

excavation objects having more durability than material of a cured casting comprising said first and second ingredients, said durability facilitating excavation of said excavation objects from within a said casting by a procedure encompassing chipping away of said casting from said objects.

10. The apparatus of claim 1, said mixing envelope comprising:

an area of reduced strength to facilitate removal of a portion of said envelope whereby to form an opening through which to pour a compound comprising mixed said first and said second ingredients.

11. The apparatus of claim 10, said mixing envelope further comprising:

structure arranged as a spout having proximal and distal ends, said proximal end being in fluid communication with said envelope, and said distal end carrying said area of reduced strength.

12. The apparatus of claim 1, said mixing envelope being sized in volumetric capacity relative to said bladder such that, when said envelope is sealed subsequent to removing excess air, said second ingredient functions substantially to reinforce said bladder whereby to resist unintentional bladder rupture.

13. A method for making an apparatus for storing, transporting, and mixing together two or more ingredients, comprising the steps of:

a) providing a mixing envelope and a preferentially rupturable bladder;

b) placing a first quantity of fluid into said bladder and sealing said bladder;

c) attaching said bladder to an interior surface of said envelope with a flexible, acrylic-based, two-sided adhesive film such that attachment of said bladder to said envelope is independent from creating a sealing seam of said envelope and such that attachment of said bladder underlies a location of indicia carried on said envelope and pointing out a location on which to press for rupture of said bladder, said adhesive film being operable to maintain said bladder inside said envelope subsequent to both rupture of said bladder and a kneading and mixing operation requiring bending of an adhesive joint formed between said film and said bladder;

d) placing a second quantity of a mix ingredient into said envelope, volumes occupied by said first and said second quantities being determined according to a desired product mix ratio and to fit within less than a maximum volume of said envelope; and e) sealing said envelope subsequent to removing excess air.

14. The method according to claim 13, further including the step of bringing a temperature of said fluid and said mix ingredient substantially into equilibrium prior to step d).

15. The method according to claim 13, wherein step d) comprises sizing a volume of said mix ingredient in cooperation with a volumetric capacity of said mixing envelope being and said bladder such that, when said envelope is sealed subsequent to removing excess air, said mix ingredient functions substantially to reinforce said bladder whereby to resist unintentional bladder rupture, but still permits intentional rupture of said bladder by a user's hand.

16. The method according to claim 14, further including, prior to step e), placing into said envelope excavation objects having more durability than material of a cured casting comprising said fluid and said mix ingredient, said durability facilitating excavation of said excavation objects from within a said casting by a procedure encompassing chipping away of said casting from said objects.

17. A container for storing, transporting, and mixing a plaster compound, comprising:

a sealed and flexible mixing envelope comprising therein:

a preferentially rupturable dispensing bladder containing therein a premeasured first quantity of water, and a premeasured second quantity of a dry plaster mix, said first and second quantities being in a ratio to each other whereby to form a plaster slurry when mixed; and wherein:

said dispensing bladder is affixed to an interior surface of said mixing envelope by a flexible adhesive operable to retain said bladder in attachment to said envelope subsequent to rupture of said bladder and mixing of said water and said plaster mix such that said bladder is retained in said envelope as a slurry comprising said water and said plaster is extracted from said envelope.

18. The container according to claim 17, said mixing envelope being sized in volumetric capacity relative to said bladder and said plaster mix such that, when said envelope is sealed subsequent to removing excess air, said plaster mix functions substantially to reinforce said bladder whereby to resist unintentional bladder rupture.

19. The container according to claim 18, said envelope further comprising:

a substantially transparent window portion through which said bladder may be seen, an outer surface of said envelope carrying:

instructions for mixing and use of said ingredients;

depictions of animal tracks at a reduced scale from full size and annotated as to their actual size; and a ruler portion for measuring animal tracks for comparison to said depictions whereby to make a track identification.

20. A container for storing, transporting, and mixing a plaster compound, comprising:

a mixing envelope comprising first and second flexible plastic membrane walls of about 0.006 inches in thickness, said envelope being sealed by application of heat and pressure whereby to join said first wall directly to said second wall at a perimeter and containing therein:

a preferentially rupturable dispensing bladder comprising a second flexible plastic membrane wall of about 0.002 inches in thickness, said bladder containing therein a premeasured first quantity of water; and a premeasured second quantity of a dry plaster mix, said first and second quantities being in a proscribed ratio of weights whereby to form a plaster slurry when first mixed; and wherein:

said dispensing bladder is affixed to an interior surface of said mixing envelope by way of a two-sided adhesive film, said bladder being affixed in a location spaced apart from a last-formed sealing seam which closes said envelope.

21. The container according to claim 20, said mixing envelope being sized in volumetric capacity relative to said bladder and said plaster mix such that, when said envelope is sealed subsequent to removing excess air, said plaster mix functions substantially to reinforce said bladder whereby to resist unintentional bladder rupture.

22. The container according to claim 21, said envelope further comprising:

a substantially transparent window portion through which said bladder may be seen, an outer surface of said envelope carrying:

instructions for mixing and use of said ingredients;

depictions of animal tracks at a reduced scale from full size and annotated as to their actual size; and a ruler portion for measuring animal tracks for comparison to said depictions whereby to make a track identification.

* * * * *